US007947930B2

(12) United States Patent
Reiter et al.

(10) Patent No.: US 7,947,930 B2
(45) Date of Patent: May 24, 2011

(54) METHOD AND CIRCUIT FOR CONTROLLING AT LEAST A HEATING ELEMENT OF A HEATING DEVICE

(75) Inventors: Werner Reiter, Vienna (AT); Uwe Grinninger, Vienna (AT); Peter Seyr, Vienna (AT)

(73) Assignee: Electrovac AG, Klosterneuburg (AT)

( * ) Notice: Subject to any disclaimer, the term of this patent is extended or adjusted under 35 U.S.C. 154(b) by 1066 days.

(21) Appl. No.: 11/723,966

(22) Filed: Mar. 22, 2007

(65) Prior Publication Data

US 2007/0221656 A1 Sep. 27, 2007

(30) Foreign Application Priority Data

Mar. 23, 2006 (DE) ..... 10 2006 013 811
Jun. 29, 2006 (DE) ..... 10 2006 030 446
Aug. 18, 2006 (DE) ..... 10 2006 038 832

(51) Int. Cl.
*H05B 1/02* (2006.01)

(52) U.S. Cl. ..... 219/493; 219/492; 219/497; 219/483; 307/39; 323/319

(58) Field of Classification Search ..... 219/492, 219/494, 497, 501, 506, 412–415, 483–487; 307/38–41
See application file for complete search history.

(56) References Cited

U.S. PATENT DOCUMENTS 3,789,190 A * 1/1974 Orosy et al. ..... 219/497
2002/0088794 A1 * 7/2002 Nelson et al. ..... 219/497

FOREIGN PATENT DOCUMENTS

| | | |
|---|---|---|
| DE | 196 17 319 | 10/1997 |
| GB | 2 325 533 | 5/1997 |
| WO | WO 02/091802 | 11/2002 |
| WO | WO 02/096157 | 11/2002 |
| WO | WO 03/063551 | 7/2003 |

* cited by examiner

*Primary Examiner* — Mark H Paschall
(74) *Attorney, Agent, or Firm* — Welsh Flaxman & Gitler LLC

(57) ABSTRACT

The invention relates to a circuit layout for controlling at least one heating element, in particular a heating element for an electric cooking and/or baking device, with at least one electric temperature sensor for measuring the temperature of the heating element and/or a surface heated by said heating element and with safety electronics for automatic shut-off of the heating element when the temperature measured by the at least one sensor reaches and/or exceeds a temperature threshold value ($T_S$).

37 Claims, 4 Drawing Sheets

FIG.1
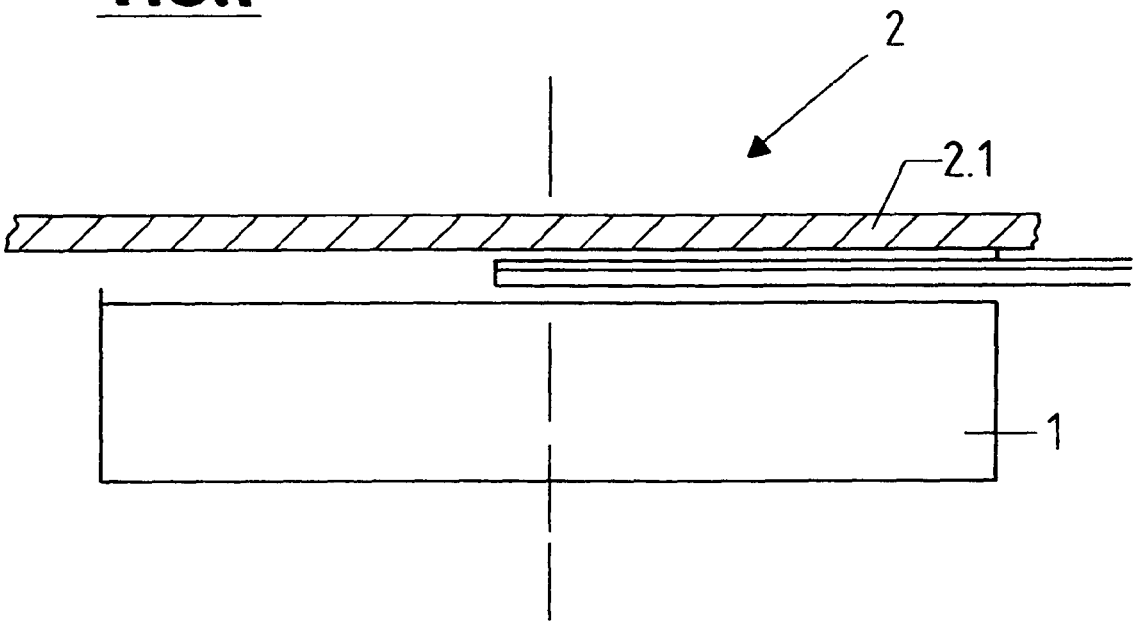
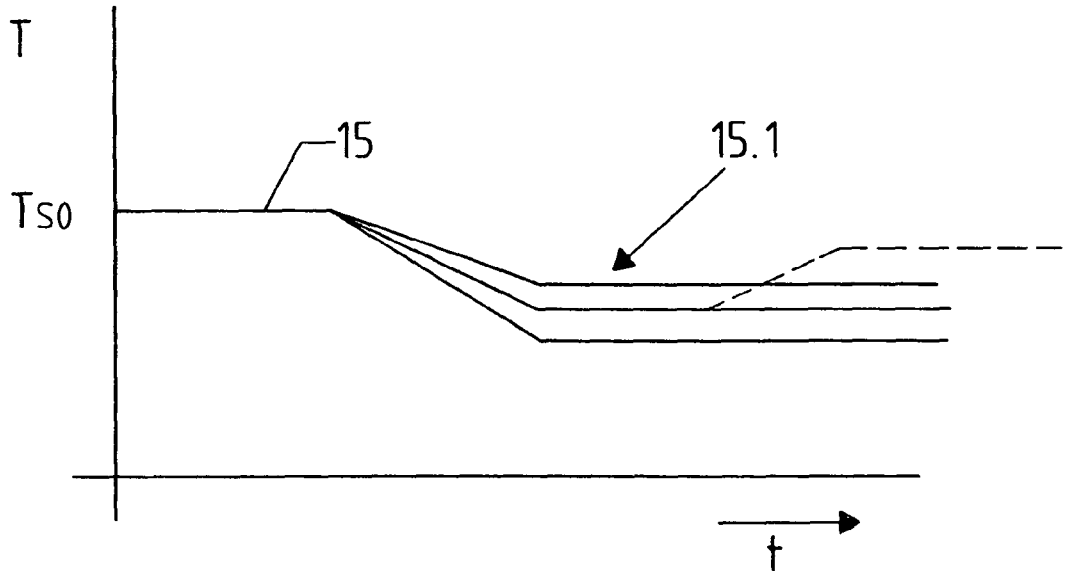
FIG. 3

FIG. 4
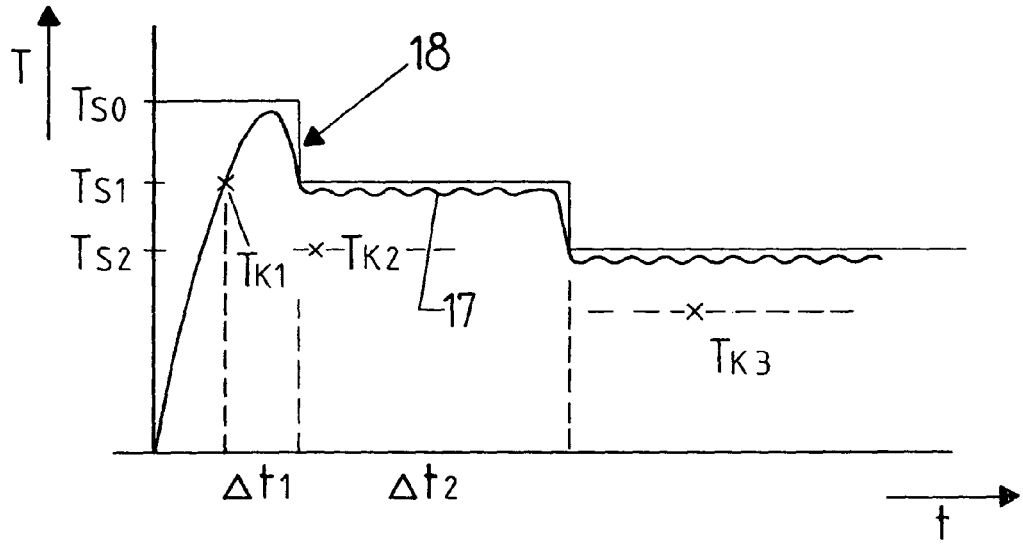
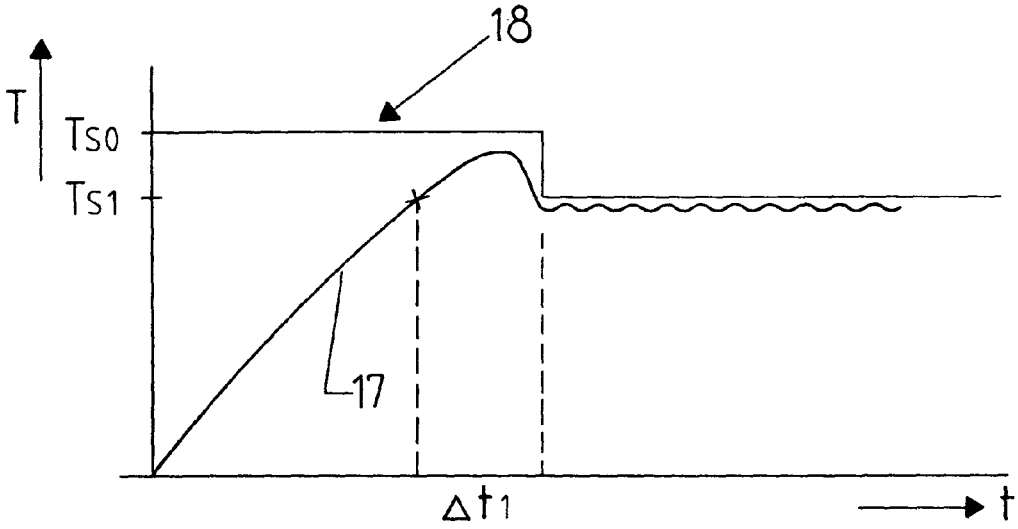
FIG. 5

METHOD AND CIRCUIT FOR CONTROLLING AT LEAST A HEATING ELEMENT OF A HEATING DEVICE

BACKGROUND OF THE INVENTION

The invention relates to a method for controlling at least a heating element, in particular a heating element of an electric cooking and/or baking device, using at least an electric temperature sensor for measuring the temperature of the heating element and/or the temperature of a body or surface heated by the heating element and for automatic switching off or switching on the heating element or reducing the electric power supplied to the heating element when a switching criterion relative to the temperature measured by the sensor is reached.

The invention relates to a circuit or circuit layout for controlling at least a heating element, in particular a heating element of an electric cooking and/or baking device, with at least an electric temperature sensor for measuring the temperature of the heating element and/or of a surface heated by said heating element and with electronics for switching on the heating element or reducing the electric power supplied to the heating element when the temperature measured by the sensor reaches and/or exceeds a temperature threshold value.

"Heating device" according to the invention generally refers to devices, in particular also such devices for household and/or commercial use, which feature at least one electrically operated heating element. Heating devices according to the invention are therefore especially, but not exclusively, devices for cooking and/or baking, in particular also electrically operated stoves.

Especially for electrically operated stoves or the cooking fields of such stoves, in particular for glass ceramic cooking fields, a method is known in the art (WO 03/007666) of controlling the respective electric heating element with a circuit layout that features control electronics and safety electronics (fail-safe electronics or circuit). The control electronics and the safety electronics are both associated with a temperature sensor, which is located directly beneath the surface (glass ceramic cooking field) and heated by the respective heating element, in order to measure as accurately as possible the temperature of the surface (glass ceramic panel) heated by the heating element. In the safety electronics the signal provided by the temperature sensor is compared with a fixed temperature threshold value, so that if the temperature measured by the corresponding temperature sensor reaches a value of 650-750° C., the heating element is automatically switched off by means of a main switch, for example by a corresponding relay. The known circuit layout assumes that a fixed temperature threshold value is necessary for reasons of safety. As a result, in particular with cooking and baking devices and especially with cooking fields, an optimization of the heating times is not possible, i.e. the heating times can be unnecessarily long.

It is an object of the invention is to present a method for controlling an electric heating element of a heating device that eliminates this disadvantage.

SUMMARY OF THE INVENTION

This objective is achieved with a method for controlling at least one heating element, in particular a heating element of an electric cooking and/or baking device, using at least one electric temperature sensor for measuring the temperature of the heating element and/or the temperature of a surface heated by the heating element and for automatic switching off or switching back on of the heating element when a switching criterion relative to the temperature measured by the at least one sensor is reached, wherein the switching criterion is generated based on actual operating parameters of the at least one heating element and/or of the heating device comprising said heating element in a logic device or controller.

This object is also achieved with a circuit for controlling at least one heating element, in particular a heating element of an electric cooking and/or baking device, with at least one electric temperature sensor for measuring the temperature of the heating element and/or of a surface heated by said heating element and with electronics for switching back the heating element when the temperature measured by the at least one sensor reaches and/or exceeds a temperature threshold value, wherein that the electronics are associated with a logic controller, in which the switching criterion is generated based on actual or real time operating parameters of the at least one heating element and/or of the heating device comprising said heating element.

The special characteristic of the invention consists in the fact that instead of a fixed switching or shut-off criterion (e.g. a temperature threshold value), a criterion is used that is determined based on relevant operating parameters and is changed dynamically during operation of the at least one heating element, depending on the actual values of the operating parameters (means dynamic switching or shut-off criterion, e.g. dynamic temperature threshold value).

Suitable operating parameters are, for example, the temperature and/or the switch-on time or duration of the respective heating element. Other relevant operating parameters for the safety of the device and/or of the surface (e.g. glass ceramic panel) heated by the heating element can also be used for generating the dynamic temperature threshold value, e.g. the temperature of the heating element or of the surface heated by said heating element, the elapsed time since the last operation of the heating element or, of course, the combination of various operating parameters. A simplified temperature- and time-dependent change in the temperature threshold value is achieved for example in that the temperature threshold value at which the heating element is switched or switched off is lower at higher temperatures measured by the at least one temperature sensor at the switch-on time than at a lower temperatures measured by the at least one temperature sensor at the switch-on time. Irrespective of this or in addition to this, the temperature-dependent control, e.g. of the temperature threshold value, can be achieved in that at higher temperatures measured by the at least one temperature sensor, the decrease of the temperature threshold value is greater than at lower temperatures.

The method according to the invention and the circuit according to the invention are suitable for both a protection function (fail-safe function), which switches off the at least one heating element or the entire cooking and baking area when the measured temperature or the measured temperatures reach the switching criterion, and also for temperature regulation. In the latter case, the respective heating element is switched or switched off upon reaching the switching criterion, in order to prevent overheating and to maintain the desired temperature or the temperature set by the user. When the temperature falls below the dynamically generated switching criterion, the heating element or the power supplied to the heating element is switched back or switched on again.

BRIEF DESCRIPTION OF THE DRAWINGS

The invention is described in more detail below based on exemplary embodiments with reference to the drawings, wherein:

FIG. 1 shows a very simplified schematic depiction of a cooking field with a heating element beneath a glass ceramic panel;

FIGS. 3-7 show various temperature/time diagrams for explaining the dynamic threshold value of the circuit layout of FIG. 1.

DETAILED DESCRIPTION OF THE DRAWINGS

Figure 2:
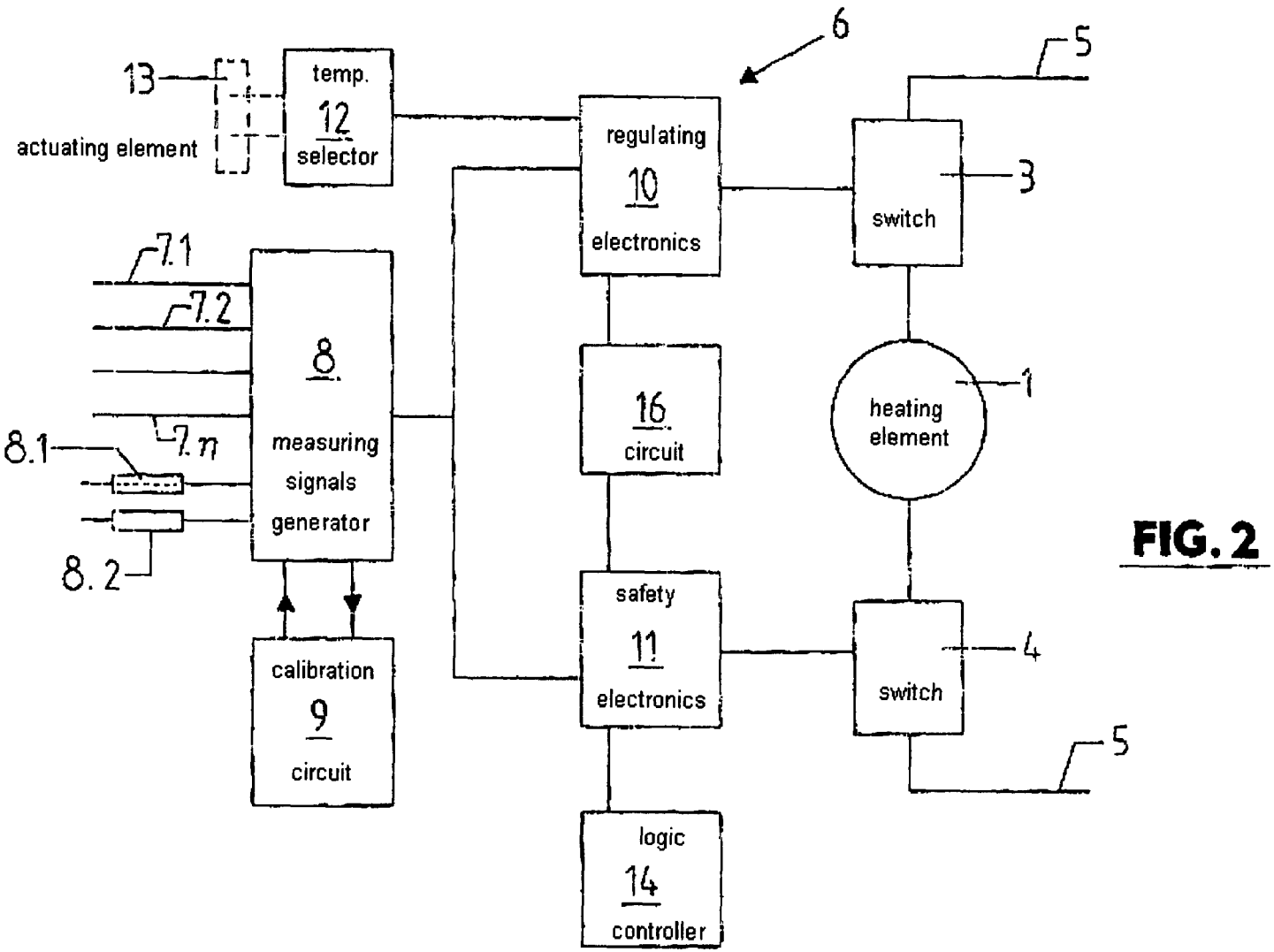
FIG. 2 shows a schematic depiction as a block diagram of a circuit layout according to the invention.

In the drawings, 1 designates an electrically operated heating element of a cooking field 2 of a cooking or baking device. The heating element 1 mounted beneath a glass ceramic field or panel 2.1 can be connected for operation via two controllable switches, namely via a control switch 3, for example a relay or triac, and via a main switch 4, for example a relay or contactor, to the supply voltage (e.g. 230 volt supply voltage) supplied to the connections 5. The arrangement of the components is such that the switches 3 and 4 are each provided in the connection between the heating element 1 and of the connections 5.

An electrical or electronic circuit generally designated 6 in FIG. 1 is used to control the heating element and the relays 2 and 3. This circuit comprises a plurality of temperature sensors 7.1, 7.2 . . . **7.*n*, each of which generates an electric measuring signal based on the measured temperature. The temperature sensors in the depicted embodiment are passive sensors, with a resistance value based or depending on the temperature and each of which is connected to an input of an electronic measuring circuit or a circuit 8 for generating the measuring signals. The circuit 8 is associated with a calibrating circuit 9, which in the manner described in more detail below is used for automatic calibration of the circuit 8**.

One of the sensors, namely the sensor 7.1, is provided on the heating element 1 beneath the glass ceramic panel 2.1, namely for monitoring the temperature of this panel. Additional temperature sensors **7.2-7.*n* are provided at one or more critical areas to be monitored in the cooking and baking device, for example at critical areas within the electronic control and monitoring circuit 6, on walls of the cooking or baking device, at areas lateral to the glass ceramic cooking field 2, for example beneath the heating element 1 and/or lateral to said element, etc. Furthermore, the additional sensors 7.2-7.*n* can also be temperature sensors of heating elements 1 or cooking fields provided adjacent to the heating element 1 beneath the glass ceramic panel 2**.

From the output port of the circuit 8, the temperature or measuring signal in particular of the sensor 7.1 is sent to the regulating electronics 10, where this measuring signal is compared as an actual value with a target or set value provided by a temperature pre-selector 12, from which a signal for controlling the switch 3 is generated. The temperature pre-selector 12 features the usual adjusting knob 13, by means of which the user can set or regulate the temperature and/or the output of the cooking field 2, so that the temperature of the glass ceramic cooking field 2 is regulated by switching the heating element 1 on and off by means of the switch 3, based on the set value and the actual value generated by the sensor 7.1.

The safety electronics 11 are supplied with the measured temperature values of all sensors **7.1-7.*n*. These measured temperature values or operating parameters are used, depending on or taking also in account further operating parameters, for example the switch-on time and/or the switch-on duration of the heating element 1, the switch-off duration of the heating element 1 since the last operation, etc. to generate a dynamic temperature threshold value in a logic device or controller 14 associated with the safety electronics 11 according to a special algorithm, so that the heating element 1 is switched off by the control electronics 11 by means of the switch 4 when the temperature of the glass ceramic panel 2.1 measured by the sensor 7.1 reaches the dynamic temperature threshold value. Generally it is also possible to monitor not only the temperature measured by the temperature sensor 7.1, but also the temperature measured by additional sensors 7.2-7.*n* to determine whether they exceed a further temperature threshold value. Also at least part of these additional temperature threshold values are then generated dynamically in the logic controller 14 based on the operating parameters. The logic controller 14 is preferably designed with a microprocessor and a corresponding program, wherein the circuit 8 provides the measuring signals at its output for example in digital form. It is also possible, for example, to design the logic controller 14** with discreet components, for example as a digital logic controller or as an analog logic controller, in which the dynamic temperature threshold value is determined from signals corresponding to the relevant operating parameters using corresponding networks.

The safety electronics 11 and the associated logic controller 14 are furthermore designed so that even when the heating element 1 is switched off, its temperature is compared with a low temperature threshold value corresponding to this operating state, the temperature threshold value being generated for example according to a separate algorithm corresponding to the switched off heating element 1.

Operating parameters for generating the dynamic threshold value are then for example the temperatures measured by the sensors **7.1-7.*n*, the temporal change of one or more of these temperatures, in particular the temporal change of the temperature measured by the sensor 7.1, the switch-on time and switch-off time of the heating element 1, the switch-on time and switch-off time of adjacent heating elements, the position of the temperature pre-selector 12 for the heating element 1, the position of the temperature pre-selector of adjacent heating elements, the switch-off time of the heating element 1**, also of any adjacent heating elements, etc.

In FIG. 3, the curve 15 shows the gradient of a dynamic temperature threshold value determined by the logic controller 14, namely as temperature T based or depending on the switch-on time t of the heating element 1, which is switched on at time t=0. The valid initial temperature threshold value $T_{S0}$ determined at this time by the logic controller 14 is based on the actual temperature of the heating element 1 or the glass ceramic panel 2.1, in such a manner that for a cold glass ceramic cooking field 2 or glass ceramic panel 2.1, the initial temperature threshold value $T_{S0}$ is higher than for a glass ceramic panel 2.1 that is still hot at the moment of being switched on. If the operating or switch-on time of the heating element 1 increase, the temperature threshold value generated by the logic controller 14 decreases, based on the current or actual operating parameters, as indicated in FIG. 3 by the group of curves 15.1. Under certain operating conditions, the temperature threshold value can also increase during operation of the heating element, as indicated by line 15.2.

A advantage of the dynamic temperature threshold value generated in this manner is that the heating element 1 and the corresponding glass ceramic cooking field 2 can be operated with increased efficiency after being switched on and therefore at a higher temperature, which is significantly higher than the temperature threshold value normally recommended for glass ceramic cooking fields, thus enabling for example fast heating of the food to be cooked and therefore reducing cooking times.

When the heating element 1 is operated at a continued high output or power, the temperature of the glass ceramic cooking field is automatically limited along the gradient of the dynamic temperature threshold value associated with the respective actual operating parameters. It is then also possible, for example, for the dynamic temperature threshold generation to intervene in the control electronics, in order to automatically keep the heating element 1 operating below the dynamic temperature threshold value.

The safety electronics 11 and the associated logic controller 14 are furthermore designed for self-monitoring, e.g. by means of plausibility checks, for example corresponding to a separate algorithm. Furthermore, the safety electronics 11 and the logic controller 14 are designed so that errors occurring within a pre-defined tolerance range during this check are stored and the heating element 1 is switched off via the switch 4 as a safety precaution when the same error occurs again. The plausibility check can, for example, ensure that the temperature measured by the sensor 7.1 must decrease when the switch 3 and/or 4 is opened. If this is not the case, then the safety shut-off occurs.

The regulating electronics 10 and/or the control electronics 11 are preferably designed so that switching of the respective switch 3 and/or 4 takes place in zero crossing (zero point) of the phase of the AC voltage supplied to the connections 5. For this purpose, a circuit 16 monitoring the zero crossing of the AC voltage is provided for sending signals to the regulating electronics 10 and to the control electronics 11.

While the temperature sensors 7.1-**7.*n* themselves have relatively high accuracy, the measuring signals generated by the circuit 8 are dependent to a considerable degree on the temperature of the control electronics 6 and the circuit 8. In order to compensate for these temperature-dependent errors, the circuit 9 conducts a calibration of the circuit 8 or of the measuring signals supplied by said circuit. For this purpose, a fixed measuring resistor 8.1 and 8.2 is provided on each of two sensor inputs of the circuit 8. These resistors are temperature-independent and are designed with low tolerances. The resistance value of the resistor 8.1 corresponds to the value of the sensors 7.1-7.*n* at a low temperature and the resistance value of the resistor 8.2 corresponds to the value of the temperature sensors 7.1-7.*n* at a higher temperature. For the calibration of the circuit 8, the respective measuring value or measuring signal at the output of the circuit 8 corresponding to the measuring resistors 8.1 and 8.2 is compared as an actual value with a target values corresponding to the measuring resistors 8.1 and 8.2 which target values are stored in the circuit 9 and then the circuit 8** or the characteristics in that circuit are changed so that the respective actual value corresponds to the corresponding target value.

FIG. 4 shows, based on the temporal curve 17 of the temperature of the heating element 1 measured for example by the sensor 7.1, the curve 18 of the dynamic temperature threshold value $T_S$, which if exceeded causes the heating element 1 to be switched off by the fail-safe function. At the switch-on time t=0, the temperature threshold value $T_S$ has the pre-defined value of $T_{S0}$. If, after switching on the heating element 1, the temperature measured at the heating element in an initial monitoring phase increases corresponding to the curve 17 and if this temperature exceeds a critical temperature value $T_{K1}$, then a timer function is activated with which, after a pre-defined time period Δt1, the temperature threshold value $T_S$ is decreased or reset to the value $T_{K1}$ corresponding to the curve 18, particularly in this embodiment by degrees, to a value that is equal to the critical temperature $T_{K1}$. Resetting of the temperature threshold value $T_S$ marks the start of a new monitoring phase. If the temperature measured at the heating element 1 remains below the decreased threshold value $T_{S1}$ that is valid for this new monitoring phase, then the heating element 1 also remains switched on. If the temperature measured at the heating element 1 does not fall below the critical temperature $T_{K1}$ and/or if the temperature measured at the heating element 1 is above a critical temperature $T_{K2}$ which is valid after decreasing the temperature threshold value to the value $T_{S1}$, then a timer function is again activated with which then after a time period Δt2 the temperature threshold value $T_S$ is again decreased or reset to the value $T_{S2}$, which together with a new critical temperature $T_{K3}$ is valid for the monitoring phase beginning with the resetting of the temperature threshold value $T_S$, etc. However, the dynamic change of the temperature threshold value $T_S$ is such that upon reaching a minimum value for the temperature threshold value $T_S$, no further decrease takes place.

FIG. 5 shows the curve 18 of the temperature threshold value $T_S$ for a curve 17 of the temperature measured at the heating element 1 that deviates from FIG. 4. As depicted by the curve 18, the temperature threshold value $T_S$ has the pre-defined value $T_{S0}$ at the switch-on time. Corresponding to the gradient of the curve 18, the temperature measured at the heating element 1 initially rises slowly and reaches the critical temperature $T_{K1}$ only after an extended period, after which the timer function is again initiated, so that after the time period Δt1 the temperature threshold value 17 is decreased to the value $T_{S1}$, which for example is again the same as the critical temperature $T_{K1}$. Due to the slowly increasing temperature of the heating element 1 after being switched on, the change of the temperature threshold value $T_S$ in the curve 17 of the temperature also takes place at a considerably later point in time than in FIG. 4. In addition, due to the more slowly increasing temperature of the heating element 1 after being switched on, the time period Δt1 is also longer than in FIG. 4.

Figure 6:
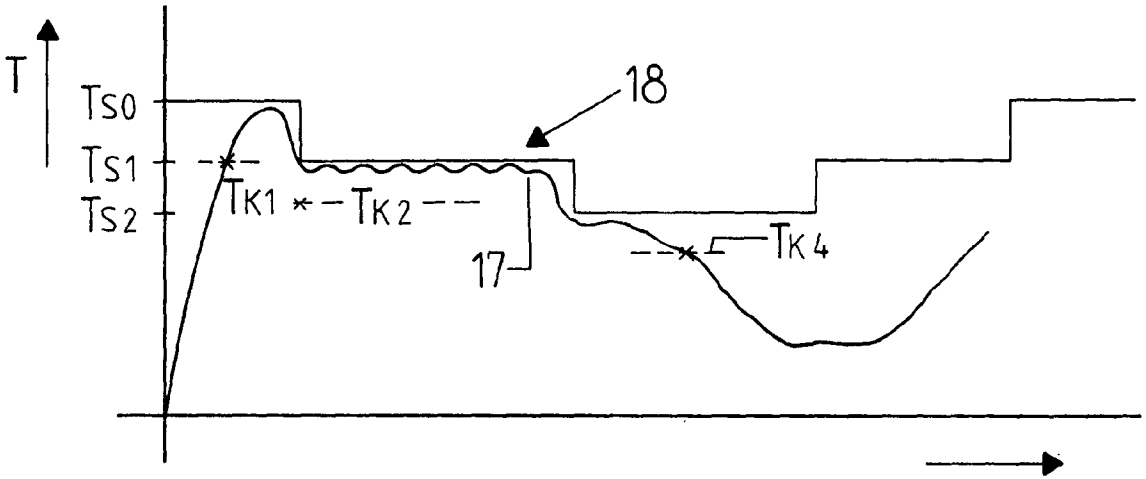

FIG. 6 illustrates with the curve 18 that the change of the temperature threshold value $T_S$ is reversible, i.e. when the temperature measured at the heating element 1 is below a critical temperature $T_{K4}$ for a pre-defined time period and/or continuously decreases over an extended period, the threshold temperature $T_S$ is increased by degrees or steps, e.g. from the value $T_{S2}$ to the value $T_{S1}$ and from there to the initial value $T_{S0}$.

Figure 7:
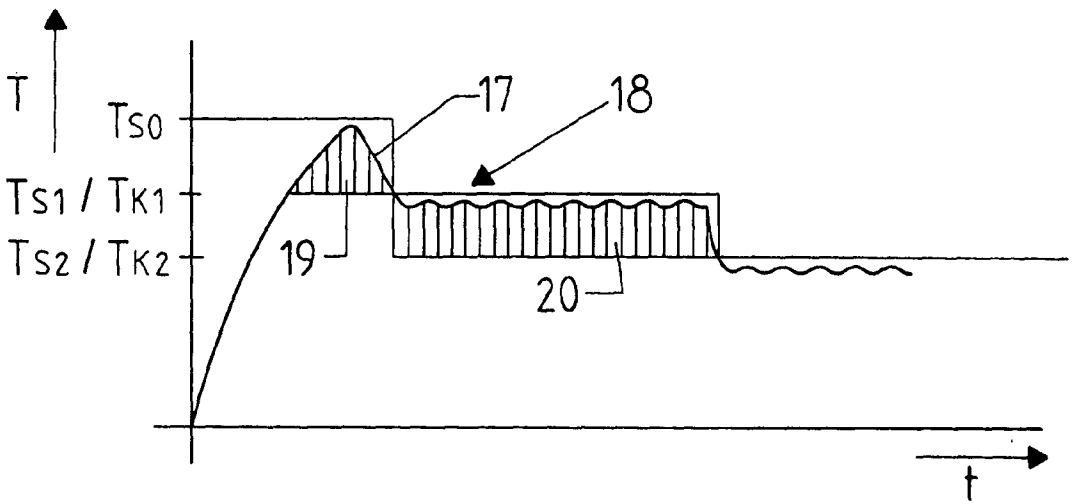

FIG. 7 shows in a temperature/time diagram the curve 18 of the temperature threshold value $T_S$ based on the curve 17 of the temperature measured at the heating element 1. In this embodiment, the criterion for changing the temperature threshold value $T_S$ is not whether the temperature exceeds or falls below a critical temperature $T_{K1}$, $T_{K2}$, $T_{K3}$, $T_{K4}$ . . . , but rather a specific power consumption by the switched on heating element 1 or an equivalent value. For this purpose, after the heating element 1 is switched on, the time integral of the temperature measured at the heating element 1 is generated in each of the successive monitoring phases, as indicated in FIG. 7 by 19 and 20. In the depicted embodiment, the time integral of the difference between the temperature measured at the heating element 1 and a reference temperature $T_{K1}$ (in the initial monitoring phase) or a temperature $T_{K2}$ (in a subsequent monitoring phase), etc. is generated in order to increase accuracy. If the time integral in the respective monitoring phase reaches a pre-defined value for that phase, then the temperature threshold value $T_S$ is decreased, e.g. in the first monitoring phase from $T_{S0}$ to $T_{S1}$, which in this embodiment is again the same as the temperature $T_{K1}$. If the actual temperature of the heating element exceeds this value $T_{S1}$, then the heating element 1 is switched off by the fail-safe function. If the temperature of the heating element 1 is below the temperature $T_{S1}$, then the heating element 1 remains switched on. In the new monitoring phase beginning with the decrease of the temperature threshold value $T_S$ the time integral of the difference between the measured temperature and a reference temperature valid for this monitoring phase, e.g. the reference temperature $T_{K2}$, is again generated. If this time integral reaches a pre-defined value, then the temperature threshold value $T_S$ is again decreased, e.g. to the value $T_{S2}$, which in this embodiment is the same as the reference temperature $T_{K2}$.

The time integrals generated for changing the temperature threshold value $T_S$ can additionally be weighted by a factor, which is for example also a function of the switch-on time of the heating element 1. With a corresponding configuration of this factor, a lower difference between the measured temperature and the respective reference temperature $T_{K1}$, $T_{K2}$, etc., already causes a decrease of the temperature threshold value $T_S$ or possibly switching off of the heating element 1 if this temperature difference exists over an extended period. The temperature difference/time integral multiplied by the weighting factor is then decisive for the change of the temperature threshold value $T_S$.

Since the change of the temperature threshold value $T_S$ is dependent on the respective temperature curve 17 and therefore takes place not at pre-defined times, but rather dynamically based on the temperature of the heating element 1 and other operating parameters, the beginning and/or end of the monitoring phases likewise are not fixed, but also change dynamically based on the temperature of the heating element 1 and other operating parameters.

It was assumed above that depending on the current or actual operating parameters, in particular allowing for or depending on the curve 17 of the temperature measured at the heating element 1, the temperature threshold value $T_S$ and therefore the switching criterion for the fail-safe function is changed.

As is evident in FIGS. 6-7 and the foregoing description of these drawings, it is also possible that the switching criterion for the fail-safe function can be achieved solely by one or more timer functions, e.g. if after switching on the heating element 1, the curve 17 of the temperature measured at this heating element reaches the critical temperature $T_{K1}$, the heating element 1 is switched off if after expiration of the time $\Delta t1$, the temperature does not fall below temperature $T_{K1}$ or a lower temperature $T_{K2}$ or $T_{S1}$ and that at a measured temperature $T_{K2}$ or $T_{S1}$, the heating element 1 is switched off by the fail-safe function after a time period $\Delta t2$ if the measured temperature of the heating element 1 is not below a critical value $T_{S2}$, etc.

Furthermore, for the sake of simplicity it was assumed above that only the temperature of the heating element 1 is taken into account for monitoring purposes. In actual practice, however, it may be useful to provide several temperature sensors and to take into account the temperatures of additional sensors, for example the temperature of adjacent heating elements and the temperature of the walls of a device equipped with one of these heating elements, e.g. a baking and/or cooking device. In this case, each measured temperature is then monitored to determine whether it exceeds a switching criterion, for example a pre-defined or dynamically generated temperature threshold value based on the current operating parameters and/or a separate timer function for the respective temperature. Switching off as a result of the fail-safe function then occurs, for example, if one of the monitored temperatures reaches the switching criterion. Here also it is possible to perform a weighting or evaluation, for example so that switching off by the fail-safe function only occurs if several monitored temperatures reach the switching criterion and/or a temperature value generated from several monitored temperatures reaches a corresponding switching criterion.

The invention was described above in connection with switching off, i.e. safety shut-off of the heating element 1 upon reaching or exceeding the dynamically generated switching criterion. In the same manner, the invention can also be used for regulating the temperature of the heating element or also for both the safety function and for temperature regulation, in which case for example, functionally separate circuits or logic controllers are provided for the two functions. For temperature regulation, upon reaching a switching criterion also based in this case on a setting (temperature setting) made by the user, there is no switching off by the fail-safe function, but rather a switching back, i.e. a decrease of the electrical output or power supplied to the respective heating element and therefore a decrease of the temperature of the heating element.

The invention was described based on exemplary embodiments. It goes without saying that modifications and variations are possible without abandoning the underlying inventive idea upon which the invention is based.

The control electronics 6 were described above with reference to various circuits or function elements. It goes without saying that single function elements or several function elements can be combined and/or that these function elements can be implemented at least partially by the use of software.

It was also assumed above that the control electronics 6 are associated with only one heating element 1. Of course, it is also possible to share the control electronics 6 or individual functions of these control electronics for several heating elements 1.

Furthermore, it was assumed above that in particular the temperature sensor 7.1 is provided for both the temperature pre-selector and/or regulator and the safety regulator, i.e. for the fail-safe function.

It is generally possible to use a separate sensor for the temperature pre-selector and/or regulator.

REFERENCE LIST

1 heating element
2 cooking field
2.1 glass ceramic panel or cooking field
3, 4 electrically controllable switch
5 external voltage supply connection
6 control electronics
**7.1-7.*n*** temperature sensor
8 circuit for generating the electronic measuring signals
8.1, 8.2 measuring or calibration resistors
9 calibration circuit
10 regulating electronics
11 safety electronics
12 temperature pre-selector
13 actuating element
14 logic controller
15 dynamic temperature threshold value
15.1 group of curves
15.2 line
16 circuit
17 curve of the temperature threshold value
18 curve of the temperature at the heating element 1

What is claimed is:

1. A method for controlling at least one heating element of a heating device, comprising at least one electric temperature sensor for measuring a temperature of the at least one heating element or a temperature of a surface heated by the at least one heating element and for controlling an automatic switching off or switching back on of the at least one heating element when a switching criterion in relation to a temperature measured by the at least one electric temperature sensor is reached or the temperature measured by the at least one electric temperature sensor reaches the switching criterion, wherein the switching criterion is generated in a logic device or controller and the switching criterion is a temperature threshold value ($T_s$) or a temporal gradient of the threshold value which is generated dynamically by specific parameters of the at least one heating element, the switching criterion comprising the following steps:

(a) when the temperature measured by the at least one electric temperature sensor exceeds a pre-defined critical temperature, a timer function is started, which after expiration of a pre-defined time period, causes a decrease of the temperature threshold value ($T_s$); and (b) dynamic generation and changing of the temperature threshold value ($T_s$) is based on the temperature and a time integral, based on a temperature measured by the at least one electric temperature sensor integrated over time, with the temperature threshold value ($T_s$) then being decreased when the temperature and the time integral exceeds a pre-defined value, depending on a gradient of a temporal change in the temperature measured by the at least one electric temperature sensor.

2. The method according to claim 1, wherein the switching criterion is generated based on the temperature measured by the at least one electric temperature sensor of the at least one heating element or of the heating device comprising the at least one heating element.

3. The method according to claim 1, wherein the temperature threshold value ($T_s$) or the temporal gradient of said threshold value is generated allowing for or depending on the switch-on time or allowing for or depending on the switch-on duration or allowing for or depending on the switch-off time of the heater before renewed operation of the at least one heating element.

4. The method according to claim 1, wherein the temperature threshold value ($T_s$) or the temporal gradient of said threshold value is generated allowing for or depending on a position of a temperature pre-selector.

5. The method according to claim 1, wherein at least one heating element includes adjacent heating elements the temperature threshold value ($T_s$) or the temporal gradient of said threshold value is generated allowing for or depending on the temperature or the temporal gradient of the temperature or of the temperature gradient or of the switch-on time and switch-off time of adjacent heating elements.

6. The method according to claim 1, wherein upon switching on the at least one heating element when at the ambient temperature, an initial temperature threshold value (Tso) is defined and this value is then changed during the further course of operation.

7. The method according to claim 6, wherein the operating parameters upon generation of the temperature threshold value ($T_s$) or of the temporal gradient of said temperature threshold value are taken into account such that the temperature measured by the at least one electric temperature sensor or the temperature increase measured by the at least one electric temperature sensor or the switch-on duration of the at least one heating element or of adjacent heating elements causes a decrease of the initial temperature threshold value (Tso).

8. The method according to claim 1, wherein errors within pre-defined tolerances during the operation of the at least one heating element are registered and that repeated occurrence of these errors causes the at least one heating element and or the heating device to be switched off.

9. The method according to claim 1, wherein after expiration of a pre-defined time period, the timer causes a decrease of the temperature threshold value ($T_s$) to a value that corresponds to a critical temperature.

10. The method according to claim 9, wherein the decrease of the temperature threshold value ($T_s$), is made depending on or as a function of an energy or power output of the at least one heating element.

11. The method according to claim 10, wherein the temperature and time integral is based on a difference between the temperature measured by the at least one electric temperature sensor and a reference temperature, wherein the reference temperature corresponds to the temperature to which the temperature threshold value is decreased when the temperature and time integral exceeds a pre-defined value.

12. The method according to claim 10, wherein a changing in the decrease of the temperature threshold value is made depending on a quotient from the energy or power output or on the temperature and time integral and a weighting factor, the value of which is a function of the switch-on duration of the at least one heating element and which increases as the switch-on duration of the at least one heating element increases.

13. The method according to claim 10, wherein the temperature threshold value ($T_s$) is increased when the temperature measured by the at least one electric temperature sensor remains significantly below a valid temperature threshold value preferably for a pre-defined time period.

14. The method according to claim 9, wherein the at least one heating element is switched off when the increasing temperature measured by the at least one temperature sensor exceeds a critical value and remains above this temperature for a pre-defined time period.

15. The method according to claim 14, wherein each time the temperature measured by the at least one electric temperature sensor reaches a critical value a new decreased value is generated, and that when this value is exceeded for a pre-defined time period, the respective heating element is switched off.

16. The method according to claim 14, wherein a duration of the predefined time period increases as the temperature decreases.

17. The method according to claim 1, wherein the switching criterion is a criteria of a safety shut-off circuit or a fail-safe circuit.

18. The method according to claim 1, wherein the switching criterion is a criteria of a temperature regulator or of a circuit for the temperature regulation of the at least one heating element.

19. A circuit for controlling at least one heating element of an electric heating device, with at least one electric temperature sensor for measuring a temperature of the at least one heating element or of a surface heated by said at least one heating element and with electronics for switching back on the at least one heating element when a temperature measured by the at least one electric temperature sensor reaches or exceeds a temperature threshold value ($T_s$), wherein electronics are associated with a logic controller, in which a switching criterion is generated based on current or actual operating parameters of the at least one heating element or of the at least one heating device comprising said at least one heating element, wherein in the logic controller, when the temperature measured by the at least one electric temperature sensor exceeds a pre-defined critical temperature, a timer function is started, which after expiration of a pre-defined time period, causes a decrease of the temperature threshold value to a value that corresponds to the critical temperature.

20. The circuit according to claim 19, wherein the switching criterion is generated based on the temperature measured by the at least one electric temperature sensor of the at least one heating element or of the heating device comprising said at least one heating element.

21. The circuit according to claim 19, wherein the switching criterion is a temperature threshold value ($T_s$), and that the temperature threshold value or the temporal gradient of said threshold value is generated in the logic controller dynamically based on current or actual operating parameters of the at least one heating element or of the heating device comprising said at least one heating element.

22. The circuit according to claim 21, wherein the temperature threshold value ($T_s$) or the temporal gradient of said threshold value is generated in the logic controller depending on the temperature measured by the at least one electric temperature sensor or depending on the temporal change of the temperature measured by the at least one electric temperature sensor or depending on the gradient of the temporal change in the temperature.

23. The circuit according to claim 19, wherein the temperature threshold value ($T_s$) or the temporal gradient of said threshold value is generated in the logic controller depending on the switch-on time or depending on the switch-on duration or depending on the switch-off time of the heater before renewed operation of the at least one heating element.

24. The circuit according to claim 19, wherein the temperature threshold value ($T_s$) or the temporal gradient of said threshold value is generated in the logic controller depending on the position of a temperature pre-selector.

25. The circuit according to claim 19, wherein the temperature threshold value ($T_s$) or the temporal gradient of said threshold value is generated in the logic controller depending on the temperature or the temporal gradient of the temperature or of the temperature gradient or of the switch-on time and switch-off time of adjacent heating elements.

26. The circuit according to claim 19, wherein upon switching on the at least one heating element when cold, i.e. when at the ambient temperature, the logic controller defines an initial temperature threshold value (Tso) and this value is then changed during the further course of operation.

27. The circuit according to claim 26, wherein the logic controller takes into account the operating parameters upon generation of the temperature threshold value or of the temporal gradient of said threshold value so that the temperature measured by the at least one electric temperature sensor or the temperature increase measured by the at least one electric temperature sensor or the switch-on duration of the at least one heating element or of adjacent heating elements causes a decrease of an initial temperature threshold value (Tso).

28. The circuit according to claim 19, wherein errors within pre-defined tolerances during the operation of the at least one heating element are registered by the logic controller and that repeated occurrence of these errors causes the at least one heating element and or the heating device to be switched off.

29. The circuit according to claim 19, wherein the logic controller provides for the changing of the temperature threshold value, as a function of the energy or power output of the at least one heating element.

30. The circuit according to claim 29, wherein the logic controller provides for the dynamic changing of the temperature threshold value ($T_s$) based on a temperature and time integral, based on the temperature measured by the at least one electric temperature sensor integrated over time, and that the temperature threshold value ($T_s$) is then decreased when the temperature and time integral exceeds a pre-defined value.

31. The circuit according to claim 30, wherein in the logic controller, the temperature and time integral is based on a difference between the temperature measured by the at least one electric temperature sensor and a reference temperature, wherein this reference temperature preferably corresponds to the temperature to which the temperature threshold value ($T_s$) is decreased when the temperature and time integral exceeds the pre-defined value.

32. The circuit according to claim 19, wherein the logic controller provides for the changing of the temperature threshold value as a function of a quotient from the energy output or of the temperature and time integral and a weighting factor, the value of which is a function of the switch-on duration of the at least one heating element, it increases as the switch-on duration of the at least one heating element increases.

33. The circuit according to claim 19, wherein the logic controller increases the temperature threshold value ($T_s$) when the temperature measured by the at least one electric temperature sensor remains significantly below a valid temperature threshold value for a pre-defined time period.

34. The circuit according to claim 19, wherein the logic controller switches off the at least one heating element when the increasing temperature measured by the at least one electric temperature sensor exceeds a critical value and remains above this value for a pre-defined time period.

35. The circuit layout according to claim 19, wherein the switching criterion is a criteria of a safety shut-off circuit or a fail-safe circuit formed by the logic controller.

36. The circuit layout according to claim 19, wherein the switching criterion is a criteria of a temperature regulator formed by the logic controller or of a circuit for the temperature regulation of the at least one heating element.

37. A circuit for controlling at least one heating element of a heating device, with at least one electric temperature sensor for measuring a temperature of the at least one heating element or of a surface heated by said at least one heating element and with electronics for switching back on the at least one heating element when the temperature measured by the at least one electric temperature sensor reaches or exceeds a temperature threshold value (Ts), wherein the electronics are associated with a logic controller, in which the switching criterion is generated based on current or actual operating parameters of the at least one heating element or of the heating device comprising said at least one heating element, wherein in the logic controller, each time the temperature measured by the at least one electric temperature sensor reaches a critical value a new decreased value is generated, and that when this value is exceeded for a pre-defined time period, the respective heating element is switched off, and wherein the logic controller provides for the changing of the temperature threshold value as a function of a quotient from the energy output or of the temperature and time integral and a weighting factor, the value of which is a function of the switch-on duration of the heating element, it increases as the switch-on duration of the heating element increases.

* * * * *